US007718953B2

(12) United States Patent
Prather et al.

(10) Patent No.: US 7,718,953 B2
(45) Date of Patent: May 18, 2010

(54) ELECTROMAGNETIC/OPTICAL TWEEZERS USING A FULL 3D NEGATIVE-REFRACTION FLAT LENS

(75) Inventors: Dennis W. Prather, Newark, DE (US); Zhaolin Lu, Newark, DE (US); Janusz Murakowski, Newark, DE (US); Shouyuan Shi, Newark, DE (US); Garrett Schneider, New Castle, DE (US)

(73) Assignee: University of Delaware, Newark, DE (US)

( * ) Notice: Subject to any disclaimer, the term of this patent is extended or adjusted under 35 U.S.C. 154(b) by 314 days.

(21) Appl. No.: 11/786,670

(22) Filed: Apr. 12, 2007

(65) Prior Publication Data

US 2007/0285803 A1 Dec. 13, 2007

Related U.S. Application Data

(60) Provisional application No. 60/791,537, filed on Apr. 12, 2006.

(51) Int. Cl.
*H05H 3/04* (2006.01)

(52) U.S. Cl. ..... 250/251; 977/901; 359/614; 359/615; 359/601

(58) Field of Classification Search ..... 250/251, 250/492.1, 227.11; 977/901; 359/614, 615, 359/601

See application file for complete search history.

(56) References Cited

U.S. PATENT DOCUMENTS 4,893,886 A 1/1990 Ashkin et al.
5,445,011 A 8/1995 Ghislain et al.
5,512,745 A 4/1996 Finer et al.
5,620,857 A 4/1997 Weetall et al.
6,159,749 A 12/2000 Liu
6,797,942 B2 * 9/2004 Grier et al. ..... 250/251
6,846,084 B2 * 1/2005 Grier et al. ..... 359/614
6,850,363 B1 2/2005 Wendenburg et al.
6,943,062 B2 * 9/2005 Chen et al. ..... 438/115
7,193,782 B2 * 3/2007 Menon et al. ..... 359/626
2002/0113204 A1 * 8/2002 Wang et al. ..... 250/251
2004/0089798 A1 * 5/2004 Gruber et al. ..... 250/251
2006/0060767 A1 * 3/2006 Wang et al. ..... 250/251
2006/0243897 A1 * 11/2006 Wang et al. ..... 250/251
2006/0249804 A1 * 11/2006 Mouli ..... 257/432

(Continued)

OTHER PUBLICATIONS

Luo, et al ("All-angle negative refraction in a three-dimensionally periodic photonic crystal" Applied Physics Letters vol. 81, No. 13 2002 pp. 2352-2354).*

(Continued)

*Primary Examiner*—David A Vanore
*Assistant Examiner*—Michael Maskell
(74) *Attorney, Agent, or Firm*—RatnerPrestia

(57) ABSTRACT

Described herein are electromagnetic traps or tweezers. Desired results are achieved by combining two recently developed techniques, 3D negative refraction flat lenses (3DNRFLs) and optical tweezers. The very unique advantages of using 3DNRFLs for electromagnetic traps have been demonstrated. Super-resolution and short focal distance of the flat lens result in a highly focused and strongly convergent beam, which is a key requirement for a stable and accurate electromagnetic trap. The translation symmetry of 3DNRFL provides translation-invariance for imaging, which allows an electromagnetic trap to be translated without moving the lens, and permits a trap array by using multiple sources with a single lens.

7 Claims, 5 Drawing Sheets

U.S. PATENT DOCUMENTS

2007/0084993 A1* 4/2007 Grier et al. ..... 250/251
2007/0114371 A1* 5/2007 Fukuchi et al. ..... 250/251

OTHER PUBLICATIONS

Jeff Tyson, "How LCDs Work" obtained from http://electronics.howstuffworks.com/lcd.htm on Aug. 19, 2009.*
Pendry, J. B., "Negative Refraction Makes a Perfect Lens," *Physical Review Letters*, 85:18, pp. 3966-3969. Oct. 30, 2000.
Cubukcu, E. et al., "Negative Refraction by Photonic Crystals," *Nature*, vol. 423, p. 604-605, Jun. 5, 2003.
Parimi, P. V. et al., "Imaging by Flat Lens Using Negative Refraction," *Nature*, vol. 426, p. 404, Nov. 27, 2003.
Lu, Z. et al., "Subwavelength Imaging by a Flat Cylindrical Lens Using Optimized Negative Refraction," *Applied Physics Letters*, vol. 87, pp. 091907-1-091907-3, 2005.
Luo, C., et al., "All-Angle Negative Refraction in a Three-Dimensionally Periodic Photonic Crystal," *Applied Physics Letters*, 81:13, pp. 2352-2354, Sep. 23, 2002.
Ao, X. et al., Three-Dimensional Photonic Crystal of Negative Refraction Achieved by Interference Lithography, *Optics Letters*, 29:21, pp. 2542-2544, Nov. 1, 2004.
Lu, Z., et al., "Three-Dimensional Subwavelength Imaging by a Photonic-Crystal Flat Lens Using Negative Refraction at Microwave Frequencies," *Physical Review Letters*, vol. 95, pp. 153901-1-153901-4, Oct. 7, 2005.
Ashkin, A., "Trapping of Atoms by Resonance Radiation Pressure," *Physical Review Letters*, 40:12, pp. 729-732, Mar. 20, 1978.
Chu, S., et al., "Three-Dimensional Viscous Confinement and Cooling of Atoms by Resonance Radiation Pressure," *Physical Review Letters*, 55:1, pp. 48-51, Jul. 1, 1985.
Chu, S. et al., "Experimental Observation of Optically Trapped Atoms," *Physical Review Letters*, 57:3, pp. 314-317, Jul. 21, 1986.
Lu, Z. et al., "Three-Dimensional Photonic Crystal Flat Lens by Full 3D Negative Refraction," *Optics Express*, 13:15, pp. 5592-5599, Jul. 25, 2005.
Simmons, R. M. et al., "Quantitative Measurements of Force and Displacement Using an Optical Trap," *Biophysical Journal*, vol. 70, pp. 1813-1822, Apr. 1996.
Visscher, K. et al., "Construction of Multiple-Beam Optical Traps with Nanometer-Resolution Position Sensing," *IEEE Journal of Selected Topics in Quantum Electronics*, 2:4, pp. 1066-1076, Dec. 4, 1996.
Ashkin, A. et al., "Optical Trapping and Manipulation of Viruses and Bacteria," *Science, New Series*, 235:4795, pp. 1517-1520, Mar. 20, 1987.
Ashkin, A. et al., "Optical Trapping and Manipulation of Single Cells Using Infrared Laser Beams," *Nature*, 330:24, pp. 769- 771, Dec. 31, 1987.
Dufresne, E. R. et al., "Optical Tweezer Arrays and Optical Substrates Created with Diffractive Optics," *Review of Scientific Instruments*, 69:5, pp. 1974-1977, May 1998.
Shelby, R. A. et al., "Experimental Verification of a Negative Index of Refraction," *Science*, vol. 292, pp. 77-79, Apr. 6, 2001.
Notomi, M., "Theory of Light Propagation in Strongly Modulated Photonic Crystals: Refractionlike Behavior in the Vicinity of the Photonic Band Gap," *Physical Review B*, 62:16, pp. 10 696-10 705, Oct. 15, 2000.
Vlasov, Y. A. et al., "Active Control of Slow Light on a Chip with Photonic Crystal Waveguides," *Nature*, 438:3, pp. 65-69, Nov. 3, 2005.
Yao, P., et al., "Multilayer Three-Dimensional Photolithography with Traditional Planar Method," *Applied Physics Letters*, 85:17, pp. 3920-3922, Oct. 25, 2004.
Pendry, J. B. et al., "Extremely Low Frequency Plasmons in Metallic Mesostructures," *Physical Review Letters*, 76:25, pp. 4773-4776, Jun. 17, 1996.
Smith D. R. et al., "Composite Medium with Simultaneously Negative Permeability and Permittivity," *Physical Review Letters*, 84:18, pp. 4184-4187, May 1, 2000.
Pendry, J. B. et al., "Magnetism from Conductors and Enhanced Nonlinear Phenomena," *IEEE Transactions on Microwave Theory and Techniques*, 47:11, pp. 2075-2084, Nov. 11, 1999.
Ashkin, A., "Acceleration and Trapping of Particles by Radiation Pressure," *Physical Review Letters*, 24:4, pp. 156-159, Jan. 26, 1970.
Gordon, J. P., "Radiation Forces and Momenta in Dielectric Media," *Physical Review A*, pp. 14-21, Jul. 1973.
Ashkin, A. et al., "Optical Levitation by Radiation Pressure," *Applied Physics Letters*, 19:8, pp. 283-285, Oct. 15, 1971.
Venkataraman, S. et al., "Fabrication of Three-Dimensional Photonic Crystals Using Silicon Micromachining," *Applied Physics Letters*, 85:11, pp. 2125-2127, Sep. 13, 2004.
Ashkin, A. et al., "Observation of a Single-Beam Gradient Force Optical Trap for Dielectric Particles," *Optics Letters*, 11:5, pp. 288-290, May 1986.
Campbell, M. et al., "Fabrication of Photonic Crystals for the Visible Spectrum by Holographic Lithography," *Nature*, vol. 404, pp. 53-56, Mar. 2, 2000.
Harada, Y. et al., "Radiation Forces on a Dielectric Sphere in the Rayleigh Scattering Regime." *Optics Communications*, vol. 124, pp. 529-541, 1996.
Citla, B. S., et al., "Fabrication of Three-Dimensional Near-IR Photonic Crystals Using Deep-UV contact Photolithography and Silicon Micromachining," *Proc. of SPIE*, vol. 6109, pp. 610903-1-610903-8, 2006.
Kosaka, H., et al., "Self-Collimating Phenomena in Photonic Crystals." *Applied Physics Letters*, 74:9, pp. 1212-1214, Mar. 1999.
Wright, W. H., et al., "Laser Trapping in Cell Biology," *IEEE Journal of Quantum Electronics*, 26:12, pp. 2148-2157, Dec. 1990.
Kosaka, H., et al., "Superprism Phenomena in Photonic Crystals," *The American Physical Society*, 58:16, pp. 096-099, Oct. 15, 1998.
Veselago, V. G., et al., "The Electrodynamics of Substances with Simultaneously Negative Values of $\epsilon$ and $\mu$ ," *Soviet Physics USPEKHI*, 10:4, pp. 509514, Jan.-Feb. 1968.

* cited by examiner

ELECTROMAGNETIC/OPTICAL TWEEZERS USING A FULL 3D NEGATIVE-REFRACTION FLAT LENS

CROSS REFERENCE TO RELATED APPLICATION

This application is based on provisional application Ser. No. 60/791,537, filed Apr. 28, 2006, the benefit of which is claimed.

STATEMENT REGARDING FEDERALLY SPONSORED RESEARCH OR DEVELOPMENT

The research for the invention was sponsored by the Air Force Office of Scientific Research. The Agreement number is A865303.

BACKGROUND OF THE INVENTION

One of the fundamental phenomena in optics is refraction, wherein naturally occurring materials obey Snell's law as a result of having positive refractive indices. However, in the 1960s, Veselago considered a notional material that had a negative refraction and proposed its use as a flat lens. Within the last several years, work on metamaterials and 'perfect lenses' revived Veselago's ideas and trigged intense discussions. Meanwhile, negative refraction was also investigated in photonic crystals (PhCs) by engineering their dispersion properties. Along these lines, experiments have demonstrated negative refraction and imaging based on negative refraction by two-dimensional PhC flat lenses. More recently, we demonstrated experimentally subwavelength imaging at microwave frequencies with a three-dimensional (3D) PhC flat lens that exhibited a full 3D negative refraction.

The belief that light carries momentum and therefore can exert force on electrically neutral objects by momentum transfer dates back to Kepler, Newton and Maxwell. However, the radiation force had not attracted much interest until the invention of lasers, which can generate light of extremely high intensity and thus exert a significant force on small neutral particles. This capability enables an unprecedented tool to trap and manipulate small particles ranging in size from the micrometer-scale down to molecules and atoms, as well as to drive specially designed particles as sensitive nanoprobes. The techniques based on radiation force have found applications in a wide range of fields including biomedical science, atomic physics, quantum optics, isotope separation, and planetary physics. One of the most successful applications is the use of optical tweezers, which relies on a single-beam gradient-force trap. In biology, optical tweezers are widely used for their ability to nondestructively manipulate small particles ranging in size from tens of nanometers to tens of micrometers. In atomic physics, optical tweezers have found applications in cooling atoms to record low temperatures and trapping atoms at high densities. To implement the optical tweezers for achieving a stable trap, one requires a highly focused and strongly convergent laser beam, which is often realized through a microscope system and is limited by the working wavelength and numerical aperture (N.A.). To manipulate or "tweeze" particles in a large field of view, the system is required to be devoid of field curvature. However, high N.A. and small field curvature are often incompatible in a conventional optical system. In practice, optical tweezers are very expensive, custom-built instruments that require a working knowledge of microscopy, optics, and laser techniques. These requirements limit the application of optical tweezers.

In the Rayleigh scattering regime ($\lambda >> r$, where r is the radius of the particle.), the radiation force acting on a dielectric particle can be explained as the interaction between the polarized particle and the applied electric field. The radiation force produced by a focused beam has two components: scattering force and gradient force. Optical tweezers rely on the gradient force, which is proportional to the dipole moment of the particle and the gradient of power density. For a spherical particle in a dielectric liquid medium, the total dipole moment can be shown to take the form $$p = 4\pi r^3 \varepsilon_b \left(\frac{\varepsilon_a - \varepsilon_b}{\varepsilon_a + 2\varepsilon_b}\right) E,$$

where $\in_a$ and $\in_b$ are the dielectric constants of the particle and the medium, respectively, and E is the applied electric field. For simplicity, we approximate the beam focused by the flat lens as a Gaussian beam. In this case, the maximum gradient force is $$F_{grad} \propto r^3 \sqrt{\varepsilon_b} \left(\frac{\varepsilon_a - \varepsilon_b}{\varepsilon_a + 2\varepsilon_b}\right) \frac{P}{W_0^3},$$

and the resulting gradient acceleration is $$a \propto \sqrt{\varepsilon_b} \left(\frac{\varepsilon_a - \varepsilon_b}{\varepsilon_a + 2\varepsilon_b}\right) \frac{P}{W_0^3},$$

where P is the power and $W_0$ is the diameter of the beam waist. Since the acceleration is inversely proportional to the cube of the beam width, squeezing the beam size is a very efficient way to increase the acceleration, and thus improve the particle trapping.

BRIEF SUMMARY OF THE INVENTION

The invention is a new device and a new use for an existing product. This invention presents a new and realistic application of the negative-refraction flat lens, namely, for electromagnetic traps (including optical tweezers).

The invention combines two recently developed techniques, 3D negative refraction flat lenses (3DNRFLs) and optical tweezers, and employs the very unique advantages of using 3DNRFLs for electromagnetic traps:

(a) Super-resolution and short focal distance of the flat lens result in a highly focused and strongly convergent beam, which is a key requirement for a stable and accurate electromagnetic trap.

(b) The translation symmetry of 3DNRFL provides translation-invariance for imaging, which allows an electromagnetic trap to be translated without moving the lens, and permits a trap array by using multiple sources with a single lens.

BRIEF DESCRIPTION OF FIGURES

FIG. 1(*b*) is a band structure of the bcc lattice PhC.

DETAILED DESCRIPTION OF THE INVENTION

Figure 1A:
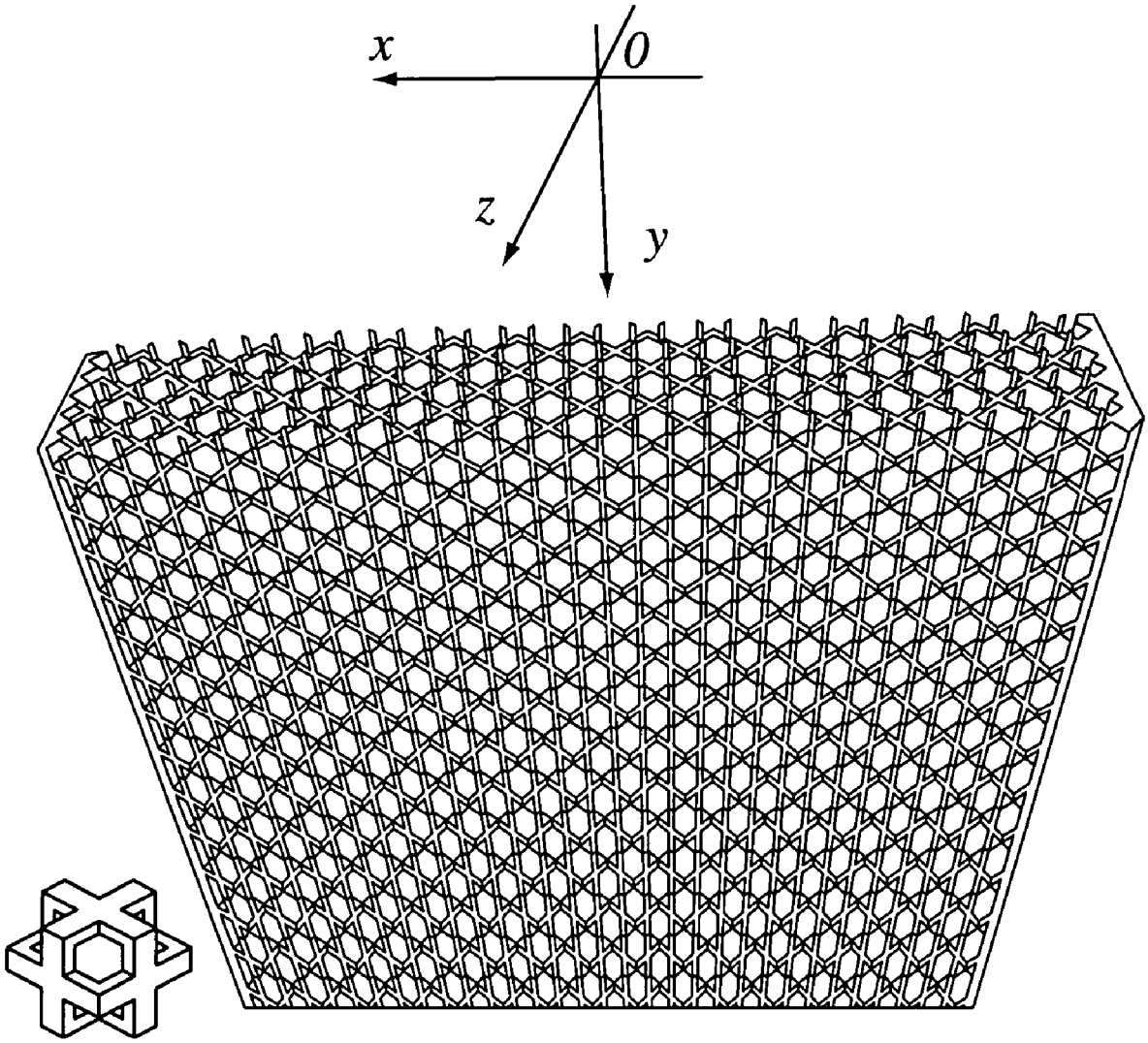
FIG. 1(*a*) is a three-dimensional PhC fabricated layer by layer (20 layers in total). The inset shows a conventional cubic unit cell of the body-centered cubic (bcc) structure.
Figure 1B:
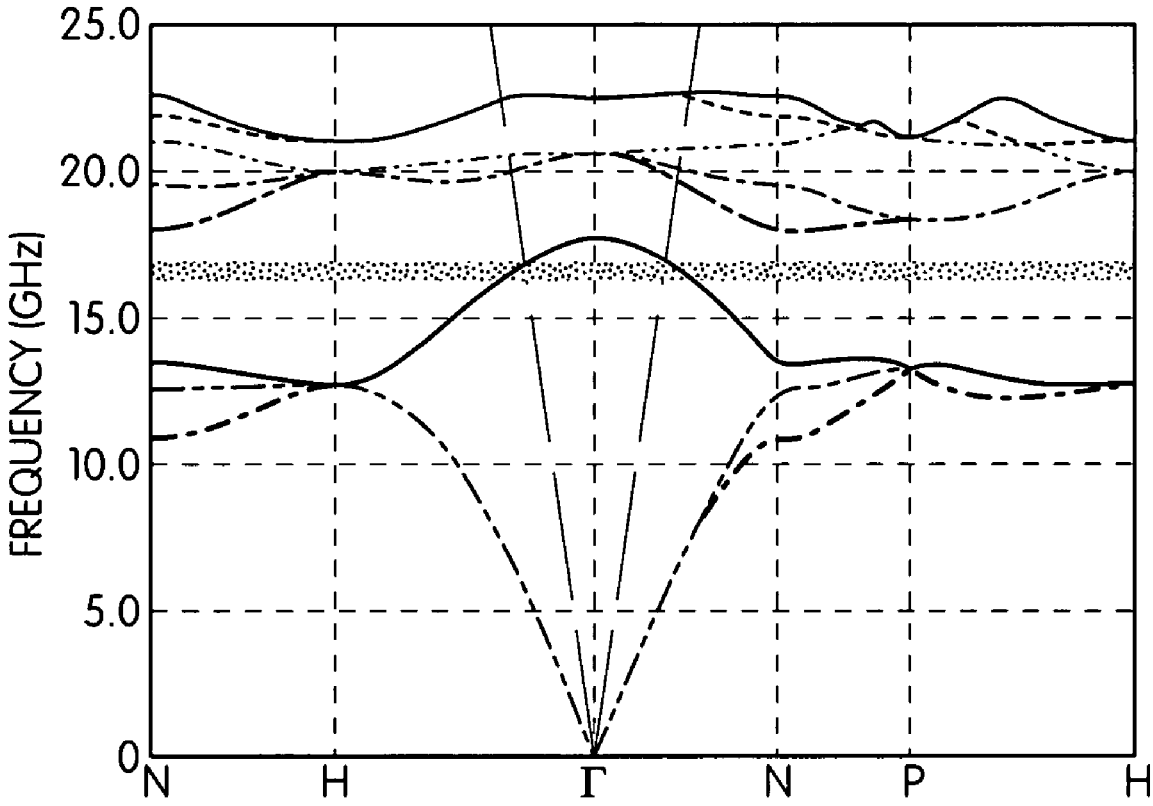

The flat lens is made of a body-centered cubic (bcc) PhC with the unit cell as shown in the inset of FIG. 1(*a*). Low loss microwave material with dielectric constant 25 was used to fabricate the PhC in a layer-by-layer process (there are 20 layers in total, and each layer has a thickness of 6.35 mm). Negative refraction is obtained by properly engineering the dispersion properties of the PhC, which are best shown using a photonic band diagram, see FIG. 1(*b*). In the photonic band diagram, group velocity is found by calculating the gradient of the frequency in k-space (wavevector space), i.e. $v_g=2\pi\nabla_k f$. Dispersion curves of regular materials have a group velocity with a positive radial component, resulting in $k\cdot v_g>0$. However, the dispersion curve at the top (15.6 GHz~17.0 GHz) of the third band of our PhC shows that frequency decreases with |k| increasing, resulting in $k\cdot v_g<0$. In other words, phase velocity is opposite to group velocity for a given electromagnetic wave as it propagates in the 3D PhC within this frequency range. The result is negative refraction. The constant-frequency surface is nearly spherical for a frequency in this range, which makes full 3D negative refraction possible.

Figure 2:
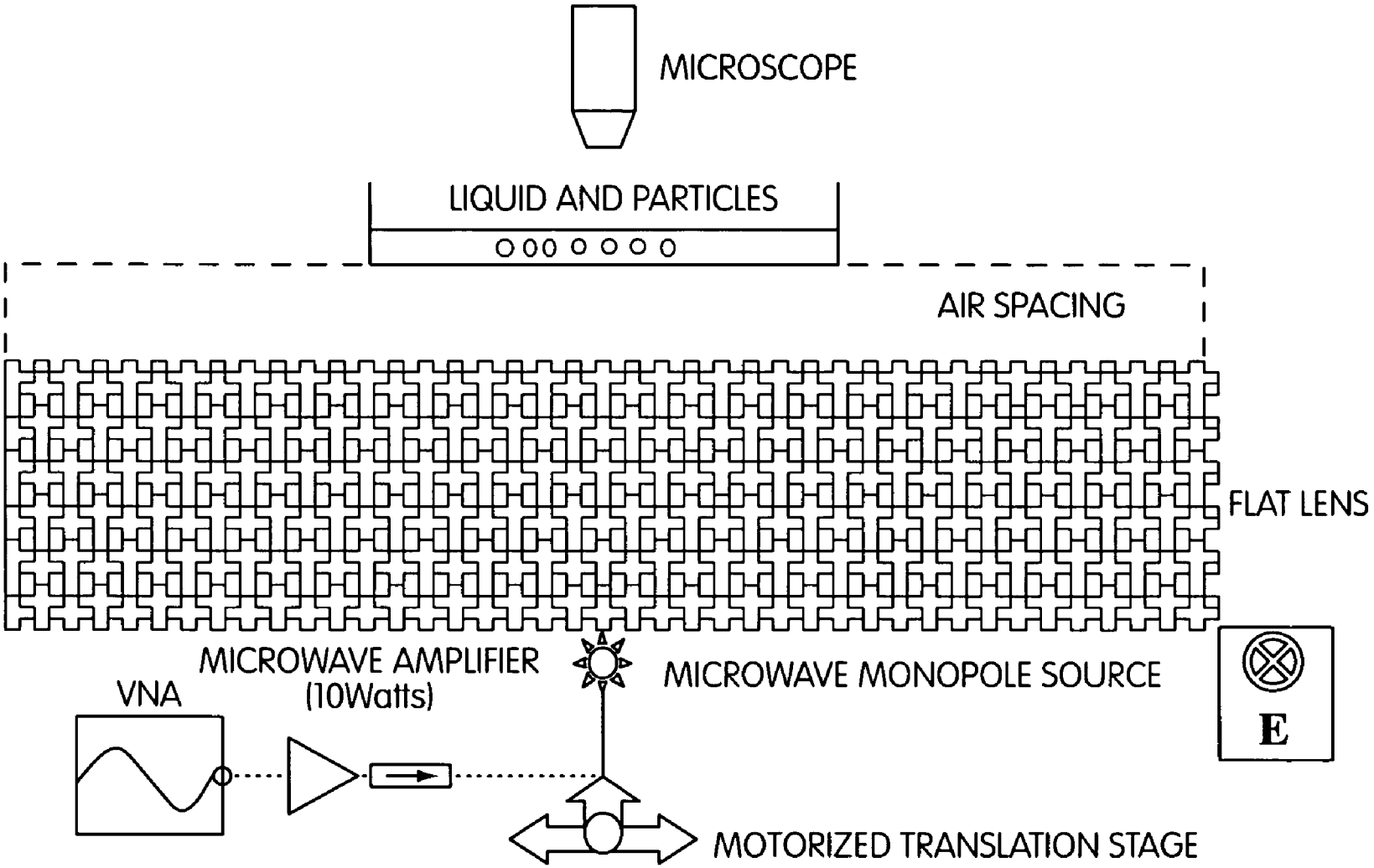
FIG. 2 is the schematic of the basic apparatus used for the microwave tweezers. The inset shows the polarization of the electric field with regard to the PhC.

To this end, an experimental setup is illustrated in FIG. 2. A 10-watt amplifier is employed to amplify the electromagnetic waves from a local oscillator, which, in this case, is a vector network analyzer. The source monopole is connected to the output port of the amplifier through a coaxial cable and an isolator to prevent back-reflection. The flat lens is placed 1 mm above the monopole with the orientation as shown in the inset. A 10-mm air gap is formed using a thin petri dish and the sample is contained in another petri dish. Both petri dishes are optically transparent, so we can see the sample and the flat lens at the same time. By tuning the frequency, the focused image of the monopole source can be located directly at the bottom of the sample dish. A stereomicroscope with a digital video camera was employed to record the experimental results.

The sample used in the experiment consists of polystyrene particles dispersed in a liquid medium, dioxane (1, 4-dioxane: $C_4H_8O_2$). Dioxane has dielectric constant $\in_b=2.1$, compared to polystyrene $\in_a=2.6$; the inequality $\in_a>\in_b$ ensures the presence of a trapping force. More importantly, dioxane molecules are nonpolar and the material is transparent at microwave frequencies and therefore exhibits very low absorption—the measured loss tangent is $2\times10^{-3}$ in the 16.0 GHz~17.0 GHz frequency range. In addition, the density of dioxane is 1.035 g/cm$^3$, which is very close to that of polystyrene, 1.04 g/cm$^3$. This helps in decreasing the effect of gravity and reduces the friction of particles that have sunk to the bottom of the container.

Furthermore, it has been demonstrated that even the movement of the source is not necessary. It is possible to control the migration route of dielectric particles by an array of sources through a single lens. In this case, we replaced the source to an array of sources and the sources are controlled by a microwave switch.

Figure 3A:
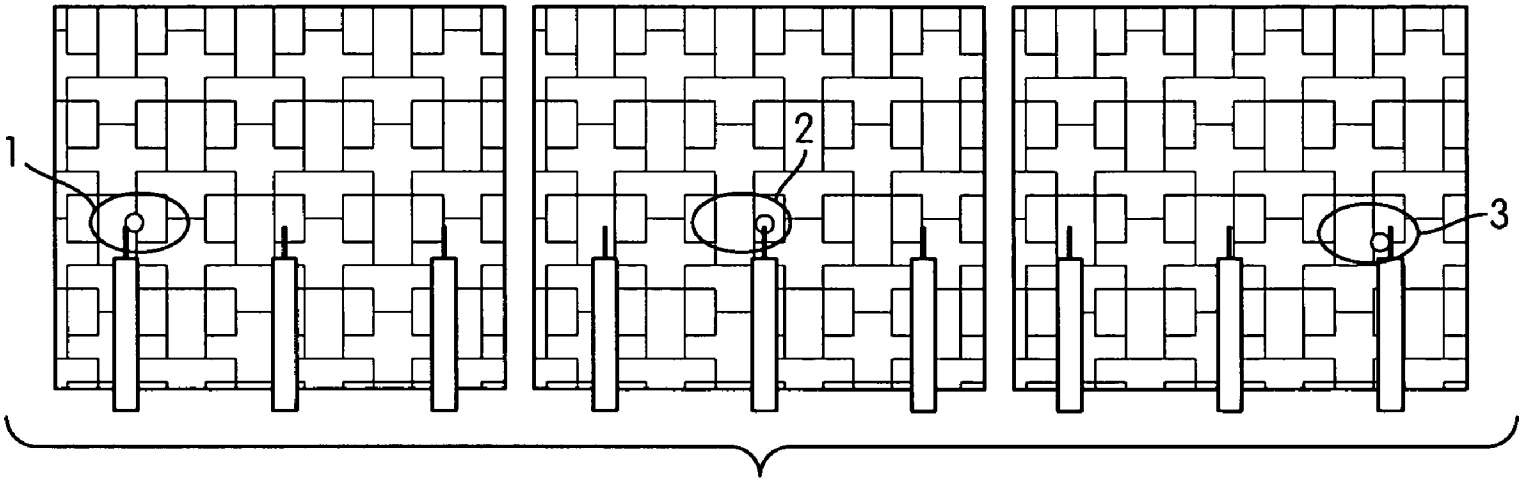
FIG. 3 shows the migration route of particles can be controlled by a source array. In this case, neither physical motion on the sources nor on the lens is required to manipulate the particles.
Figure 3B:
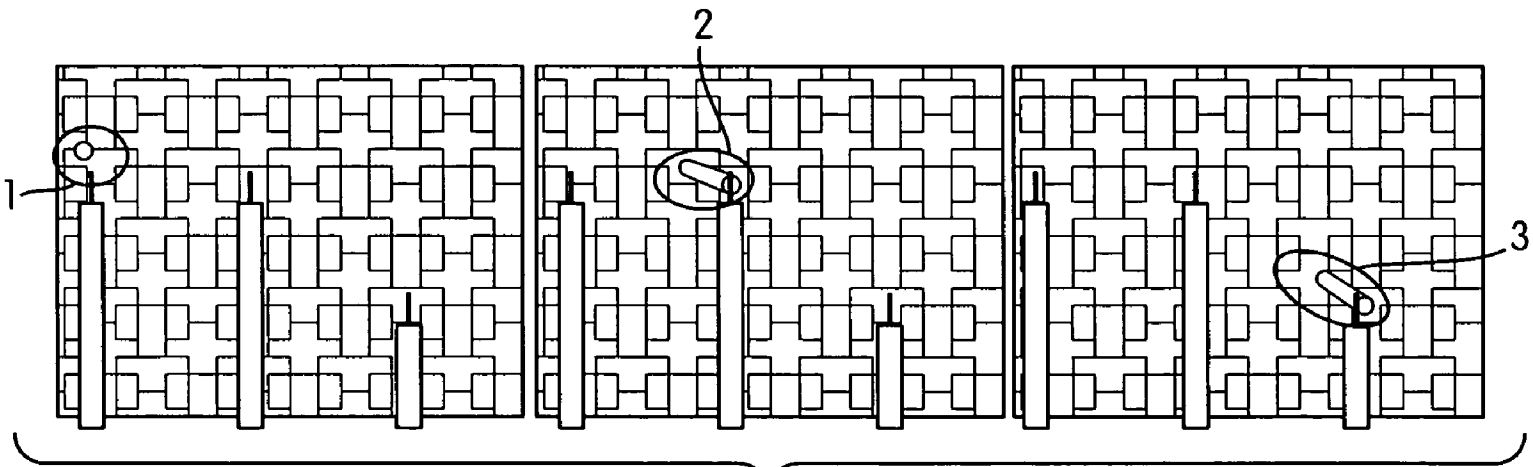

In this experiment, sources in the array were consecutively switched on and off. As shown in FIG. 3, the particle cluster follows a designated route. After the first source was switched on, the particles were trapped to position 1. Then when the second source was switched on, the particles migrated from position 1 to position 2. The process can continue until the particles reach the position desired. In a linear array, the particles move in a straight line as shown in FIG. 3(*a*); in a step in a linear array, the particles move following a step as shown in FIG. 3(*b*). The distance between two adjacent sources is 8 mm, which is less than 0.5λ (λ is the working wavelength).

Figure 4:
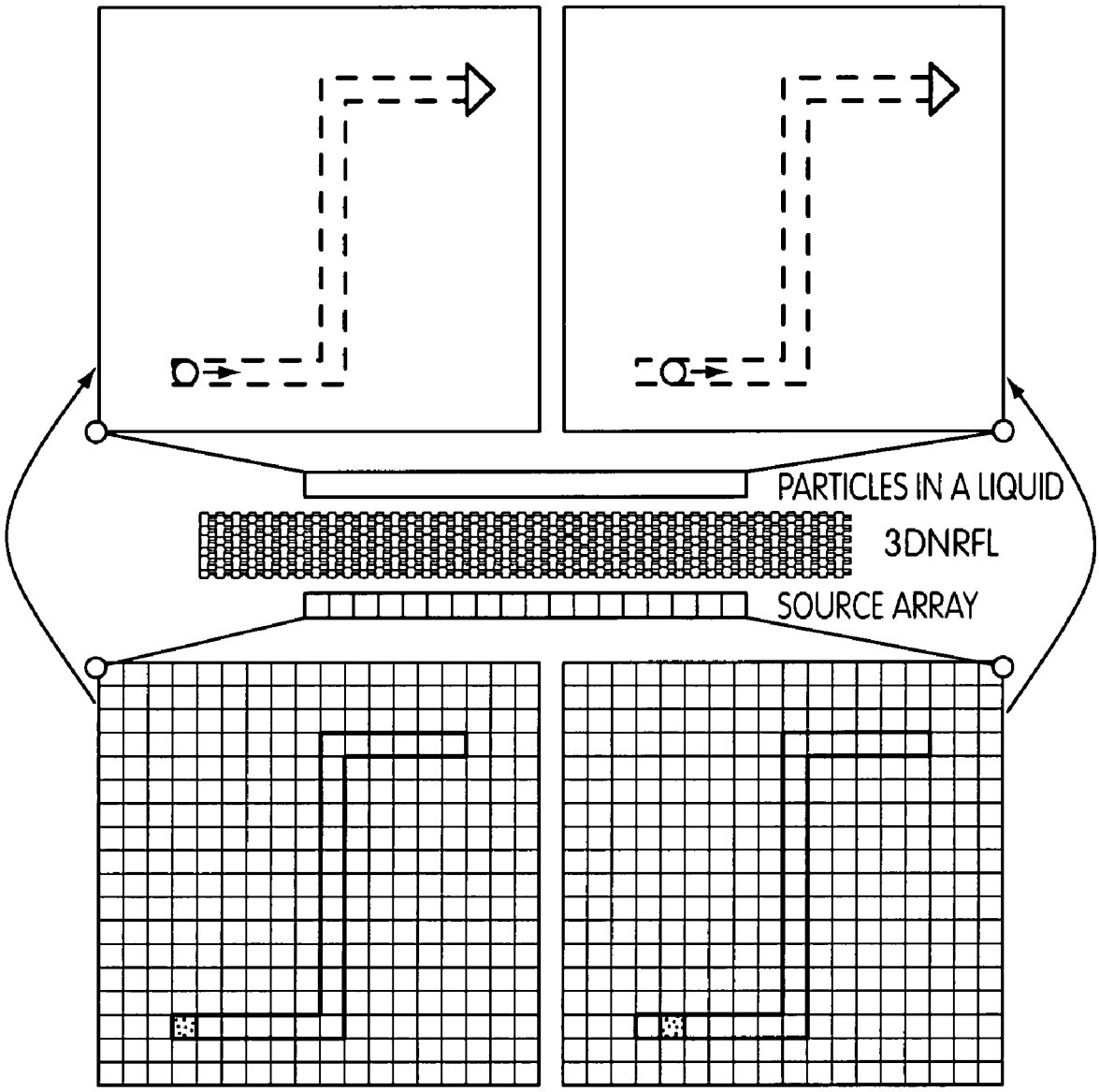
FIG. 4 shows that particles can be manipulated along a microchannel formed and controlled by a source array.

Based on these results, it is shown that optical tweezer array can be created through a single 3D negative refraction flat lens. The super-resolution and translation-invariant imaging ensure all sources in a plane parallel to the lens surface have their corresponding subwavelength images. The source array can be simply a liquid crystal display (LCD) plate with subwavelength period (e.g. 0.3~1.0λ) and each source in the array corresponds to one pixel. When the particles have higher dielectric constant than the liquid, the particles will be trapped to the brightest image. As a result, by electrically controlling the position of the brightest pixel, one can control the trapping position. More importantly, one can manipulate the particles along a specific route, namely a microchannel, by turning on and off the brightest pixel sequentially, see FIG. 4. As illustrated in FIG. 4, if the pixels enclosed by the solid lines on the source array are turned on and off sequentially, particles on the image side will follow the route defined by the dashed lines. In this case, neither physical motion of the source nor physical motion of the 3D negative refraction flat lens is required. The source array completely defines a specific microchannel. In contrast, in a conventional system arrays of optical tweezers are realized by arrays of spherical or diffractive lenses, which have the limitations of a fixed array pattern and element spacing restricted by the lens size. The lens spacing is of tens of wavelengths. At such distances, the trapping force between two adjacent lenses becomes very weak and the handover between tweezers are often impractical.

What is claimed is:

1. A device for generating an electromagnetic trapping force for manipulating a position of a particle, the device comprising:

(a) a negative-refraction lens; and (b) a source of electromagnetic radiation comprising an array of source elements, wherein said lens focuses radiation emanating from said source of electromagnetic radiation to produce a light intensity or an electromagnetic field, said negative-refraction lens and said source are non-movable, and said source of electromagnetic radiation is configured to manipulate the position of the particle by selective activation of the source elements in the array of source elements.

2. The device of claim 1 wherein said negative-refraction lens comprises a 3D negative-refraction flat lens.

3. The device of claim 1 wherein said source comprises a liquid crystal display plate.

4. A method for manipulating the position of a particle comprising the steps of (a) focusing radiation from a non-movable source of electromagnetic radiation through a non-movable negative-refraction lens onto said particle; and (b) varying the radiation from said source to manipulate the position of said particle.

5. The method of claim 4 wherein the said negative-refraction lens comprises a 3D negative-refraction flat lens.

6. The method of claim 4 wherein the said source comprises a liquid crystal display plate.

7. The device of claim 1, further comprising a controller configured to control the selective activation of the source elements.

* * * * *